US006195896B1

(12) United States Patent
Ireland

(10) Patent No.: US 6,195,896 B1
(45) Date of Patent: Mar. 6, 2001

(54) SAFETY KNIFE

(76) Inventor: William Alfred Ireland, 257 Pirton Lane, Churchdown, Gloucestershire (GB)

( * ) Notice: Subject to any disclaimer, the term of this patent is extended or adjusted under 35 U.S.C. 154(b) by 0 days.

(21) Appl. No.: 09/328,443

(22) Filed: Jun. 9, 1999

(30) Foreign Application Priority Data

Jun. 16, 1998 (GB) ..... 9812829
Sep. 2, 1998 (GB) ..... 9819037
Mar. 8, 1999 (GB) ..... 9905120

(51) Int. Cl.[7] ..... B26B 5/00
(52) U.S. Cl. ..... 30/2; 30/294
(58) Field of Search ..... 30/2, 294, 293, 30/124, 125

(56) References Cited

U.S. PATENT DOCUMENTS 1,562,429 * 11/1925 Unsinger ..... 30/2
2,686,360 * 8/1954 Fisher ..... 30/2

* cited by examiner

*Primary Examiner*—Douglas D. Watts
(74) *Attorney, Agent, or Firm*—Young & Thompson

(57) ABSTRACT

A safety knife comprises a handle, a main blade mounted on the handle with a pointed end part of the cutting edge of the blade projecting from the handle at an obtuse angle, and a guard mounted on the handle to shield the projecting portion of the blade. The guard comprises a further blade which is mounted on the handle in generally the same plane as the main blade and has a concavely curved cutting edge which extends around the projecting point of the main blade. The outer edge of the guard blade is unsharpened so that the guard blade protects and shields the point of the main blade as well as contributing to the cutting action of the knife.

23 Claims, 4 Drawing Sheets

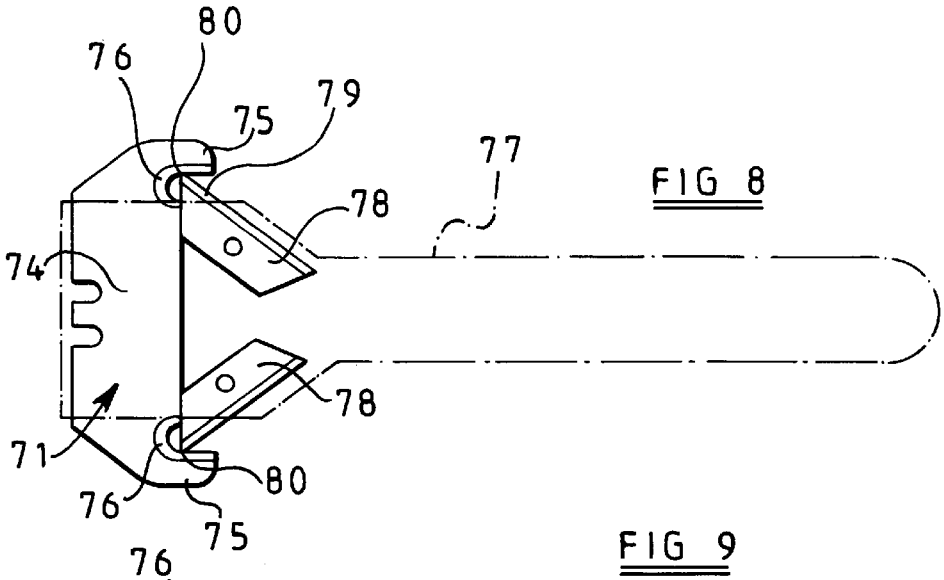
FIG 8
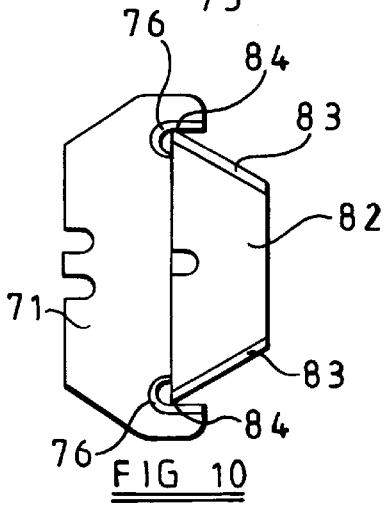
FIG 10
FIG 9
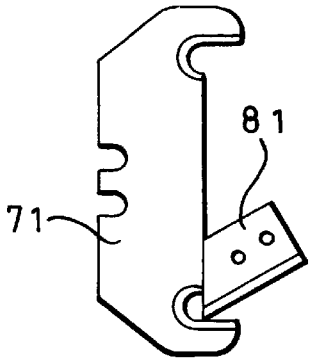
FIG 11
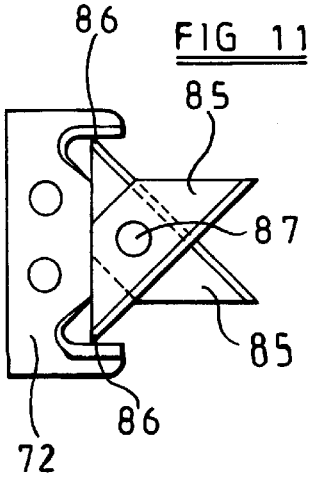
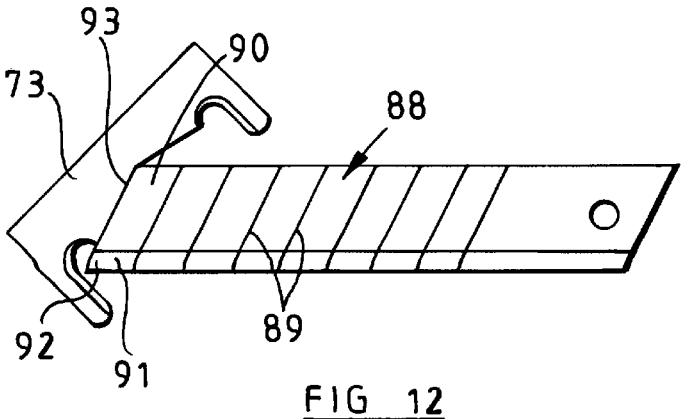
FIG 12

SAFETY KNIFE

BACKGROUND OF THE INVENTION

The invention relates to safety knives of the kind comprising a handle, a main blade mounted on the handle with at least a portion of the cutting edge of the blade projecting from the handle, and a guard mounted on the handle to shield the projecting portion of the blade.

SUMMARY OF THE INVENTION

According to the present invention, in a safety knife of this kind, the guard comprises a further blade which is mounted on the handle in generally the same plane as the main blade and has a cutting edge at least a part of which is directed towards said projecting portion of the main blade.

Preferably at least a portion of the cutting edge of the further blade is concavely curved and extends around a part of the cutting edge of the main blade.

Preferably the concavely curved portion of the further blade extends around a junction between the cutting edge of the main blade and an adjacent edge of the main blade. The adjacent edge of the main blade may be sharpened or unsharpened.

The portion of the concave edge of the further blade which extends around a part of the cutting edge of the main blade preferably extends at an acute angle to the cutting edge of the main blade. For example, said portion of the curved edge may extend generally parallel to an edge surface of the handle from which the main blade projects, or at a small angle to the parallel direction.

The further blade may be formed at one end with a tang having an inner edge, which forms part of said concave edge around part of the cutting edge of the main blade, and an outer edge. Preferably the free end of the tang is at least partly rounded.

Preferably also the distance of the tang from said edge surface of the knife handle is such as to engage the finger of a user should it move towards the exposed cutting edge of the main blade, thereby to prevent, or reduce the risk of, the finger coming into cutting contact with the exposed portion of the main blade.

In any of the above arrangement a portion of the cutting edge of the main blade may project at an obtuse angle beyond an edge surface of the handle of the knife.

The main blade may have an angle between the exposed portion of its cutting edge and the blade edge which is adjacent said exposed portion which is about 90°. Alternatively the angle between said edges may be less than 90°. The main blade may be trapezium shaped so that, by reversing the blade longitudinally, opposite pointed ends of the blade may project beyond the edge surface of the knife handle.

The further blade may be a cutting blade of the kind comprising a central portion having front and back unsharpened edges and two similar hook-shaped portions at opposite ends thereof, each hook portion comprising an inner concave sharpened cutting edge and an outer unsharpened edge. In this case the knife may include two main blades, cooperating with the two hook portions respectively. Alternatively, each hook portion may cooperate with a different portion of a single main blade.

In the case where the main blade is trapezium shaped an unsharpened end edge of the main blade may extend along or substantially parallel to the unsharpened inner edge of the hooked blade with the point between said end edge of the main blade and the cutting edge of the main blade projecting into the concavely curved cutting edge of the hooked blade so that the point of the main blade lies adjacent the cutting edge of the hooked blade.

BRIEF DESCRIPTION OF THE DRAWINGS

FIGS. 9–12 show further alternative blade configurations for the safety knife and, FIGS. 13 and 14 are further diagrammatic longitudinal sections throughout other forms of knife according to the invention.

DETAILED DESCRIPTION OF THE PREFERRED EMBODIMENTS

Referring to FIGS. 1–5 of the drawings, the knife comprises a handle 10, formed from two overlying parts: an upper part 11 and a lower part 12. Each part is essentially a mirror image of the other, the two parts being pivotally connected together by a pivot pin 13 so that they may be swung from the open position shown in FIG. 1, where the parts are arranged at an angle to one another, and the closed position shown in FIGS. 2 and 3 where the two parts of the handle overlie one another.

Figure 2:
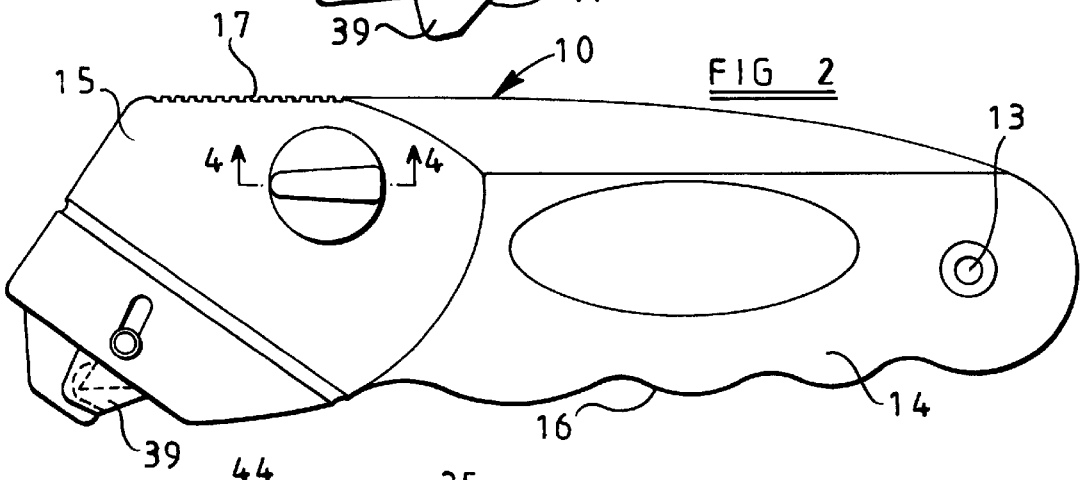
FIG. 2 is a similar view showing the knife in the closed position and ready for use.
Figure 3:
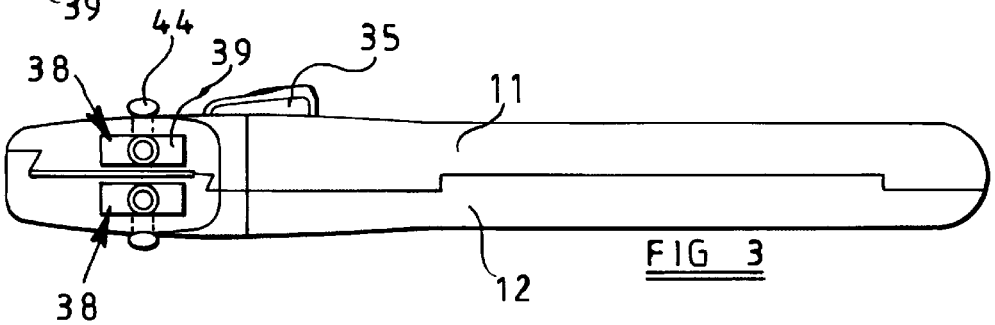
FIG. 3 is a view from below of the knife in the closed position.

In the closed position shown in FIGS. 2 and 3 the shaped outer surfaces of the two parts of the handle provide a handgrip portion 14 and a head portion 15. The underside of the handgrip portion is shaped, as indicated at 16, to receive the user's fingers as the hand grips the knife, and an upper portion 17 is formed with transverse ribs against which the user's thumb may rest.

The knife comprises two operative blades, a trapezium shaped main blade 18 and a double-ended hooked blade 19. Each blade is received in a shallow recess in the inner surface of the lower handle part 12, so that the blades are clamped between the two halves of the knife handle when these are brought into overlying relationship.

Figure 1:
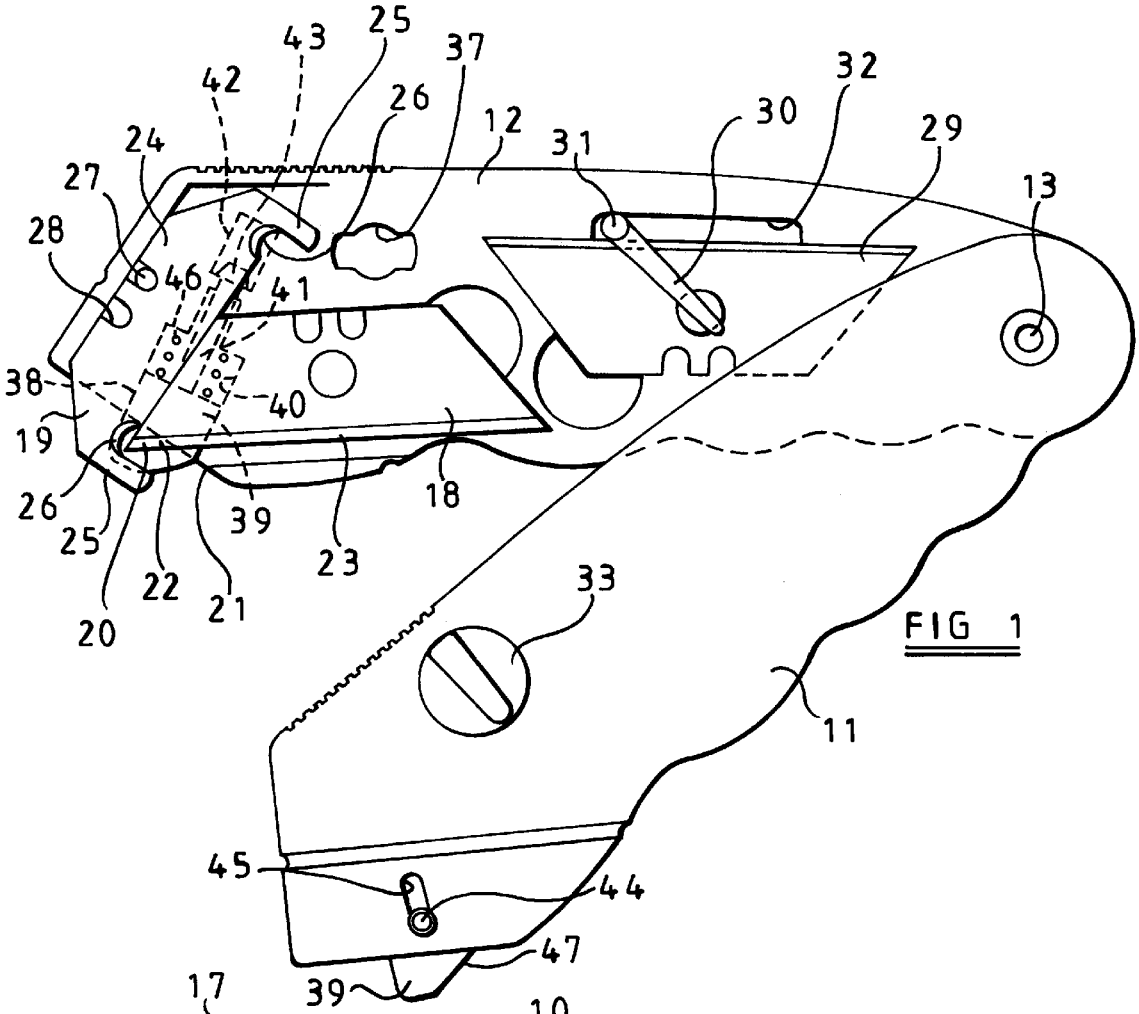
FIG. 1 shows a safety knife according to the present invention, shown in an open position.

As best seen in FIG. 1, the main trapezium shaped blade 18 is so located within the knife handle that a pointed end 20 of the blade projects beyond an inclined edge surface 21 of the handle so that the exposed portion 22 of the cutting edge 23 of the main blade extends at an obtuse angle to the edge 21 of the handle.

The hooked guard blade 19 is of the kind having a central portion 24 having two parallel unsharpened edges, opposite ends of the blade being formed with transverse tangs 25 extending approximately at right angles to the main axis of the blade. Concavely curved sharpened cutting edges 26 are formed between the tangs 25 and the main central portion of the blade 19. The two blades 18 and 19 are so located in relation to one another that one unsharpened main side edge of the blade 19 lies alongside an inclined end edge of the blade 18. One of the tangs 25 of the blade 19 is disposed outwardly beyond the exposed pointed extremity 20 of the main blade 18 so that the curved cutting edge 26 adjacent that tang extends around the point 20 of the main blade 18. As will be seen from FIG. 1, the inclined unsharpened edge of the main blade 18 extends at approximately a right angle to the edge surface 21 of the handle, and the adjacent tang 25 on the guard blade 19 extends generally parallel to the surface 21.

The two blades may be located in the shallow recesses in the lower part 12 of the handle by being closely embraced by those recesses. Alternatively or additionally, however, the lower part 12 of the handle may be provided with projecting bosses, such as indicated at 27, which locate within one or more of the slots 28 conventionally provided in such blades, so as to assist in locating them.

Spare blades, indicated at 29, are stored within a suitably shaped recess within the handgrip part of the knife handle. This recess is deep enough to hold two or more blades stacked one-upon-the-other and a spring arm 30 is mounted to one side of the recess, as indicated at 31, and bears on the topmost spare blade so as to prevent the spare blades rattling when the handle is closed, or falling out of the recess when the handle is open. The mounting 31 is such as to allow the spring arm 30 to be swung to one side, and received in a recess 32, thus enabling a spare blade to be removed when required.

A quick release fastener 33 is provided to lock the two parts 11 and 12 of the handle together when they are in a overlying relationship. The construction of the fastener is shown in greater detail in FIGS. 4 and 5.

Referring to those figures, the fastener comprises a circular shaft 34 which is received in a hole in the upper handle part 11 and is formed with a circular manipulating head 35. The lower end of the shaft 34 is formed with two diametrically opposed lugs 36 which cooperate with a shaped slot 37 in the lower handle part 12. In one rotational position of the shaft 34 the lugs 36 may pass through the slot 37. The shaft is then turned clockwise through 90° bringing the lugs 36 into a position where they lie at right angles beneath the slot 37 thus locking the two halves of the handle together. When it is required to separate the two halves of the handle, the shaft 34 is rotated anticlockwise through 90°, bringing the lugs 36 into register with the slot 37. The shaft 34 may then be withdrawn axially out of the slot 37 so as to be disengaged from the slot allowing the two halves of the handle to be swung apart. The shaft 34 may be lifted by manually pulling on the manipulating head 35, or the shaft may be automatically biased upwardly by a spring, for example by a helical compression spring which encircles the shaft 34 between the underside of the manipulating head 35 and an annular abutment on the upper handle part 11.

The knife, when closed, may be used to cut sheet material, for example thick cardboard, by pulling the exposed portions of the blades 18 and 19 over the edge of the sheet material and drawing the knife towards the user so that the cutting edge of the exposed point 20 cuts into the material as it enters the slot between the tang 25 and the adjacent surface 21 of the knife handle. As the material passes the pointed part 20 of the main blade 18 it meets the concavely curved cutting edge 26 of the guard blade 19. The curved cutting edge 26 cuts any part of the thickness of the material which passes beyond the pointed tip 20 of the main blade 18 and which does not therefore become fully severed by the main blade.

Instead of drawing the exposed blades over an exposed edge of a material to be severed, the tang 25 may also be forced through the material at a location away from its edges, by using sufficient force, the knife being drawn towards the user once the tang has been plunged through the material. The knife is therefore particularly suitable for ripping open cardboard boxes, self-adhesive wrapping tape, paper sacks and the like, where it may not be possible to apply the knife to an exposed edge of the material to be cut. The knife may also be used for cutting other materials such as strapping, string or other similar packaging materials.

The arrangement of the two blades ensures that there is little risk of fibres or other particles form the material becoming jammed in the blade, as can often happen with other safety knife blade arrangements. Although, as explained above, it is desirable for the concave edge of the guard blade to be sharpened, and therefore provide an auxiliary cutting action, the invention does not exclude arrangements where the guard blade is not sharpened, but simply comprises a blade-like element of substantially constant thickness and having an unsharpened edge around the pointed tip of the main blade.

Most importantly, however, as may be seen from FIGS. 1 and 2, the unsharpened outer edges of the blade 19 and tang 25 provide a safety guard around the pointed tip 20 of the main blade 18 thus preventing, or reducing the risk of, the user's finger, or other part of the body, coming into contact with the point 20 of the blade or the exposed portion 22 of its cutting edge. The knife can therefore be safely left lying around, or kept in a pocket, with little risk of accident, while at the same time always being ready for use.

As a further safeguard for this purpose, the knife may also be provided with spring-loaded guard assemblies 38 located on each side of the exposed portions of the blades 18 and 19.

Each guard assembly comprises a guard pad 39, which is slidable within a recess 40 formed in each part 11, 12 of the knife handle. A rod 41 extends rearwardly from each guard pad 39 and extends through a hole leading from the slot 40 to a smaller auxiliary recess 42. The extremity of the rod 41 within the recess 42 has an enlarged head 43 to limit the extent to which the guard 39 can project from the recess 40. During assembly the enlarged head 43 snaps through the hole. The rod 41 and enlarged head 43 may be integrally moulded with the guard 39. Alternatively, the rod 41 may be screw-threaded, the enlarged head 43 comprising a nut in screw-threaded engagement with the end of the threaded rod, so that the extent to which the guard 39 projects from the recess 40 may be adjusted. Alternatively or additionally, the extent of movement of each guard 39 may be controlled by a laterally extending pin 44 on the guard which slides along a slot 45 in the handle part. A helical compression spring 46 encircles the rod 41 between the rear surface of the guard 39 and the end of the recess 40 so as to bias the guard 39 outwardly. Alternatively, a compression spring may be provided between the enlarged end 43 of the rod 41 and the end surface of the recess 42.

As may be seen from FIGS. 1 and 2, each guard 39, when in the fully extended position, overlies the exposed portions of the cutting edges of both the main blade 18 and the guard blade 19. As the blades are drawn over the cardboard or other material being cut the pressure of the material passing into the slot between the tang 25 and the surface 21 forces the two guards 39 back into their respective recesses 40, against the action of the spring 46 so that the material engages the cutting edges of the blades.

The guards 39 increase the safety of the knife and reduce even further the risk of a user's finger or other body part engaging the cutting edges of the blades, since they prevent the user's finger or other body part from contacting the side faces of the exposed part of the blades, which might otherwise result in the user being cut, particularly if the pointed end 20 of the main blade does not happen to be exactly co-planar with the tang 25 on the guard blade 19. The guards also reduce the risk of clothing becoming snagged on the blades.

The shape of the guards 39 is so chosen in relation to their direction of sliding movement that it is unlikely that a user's finger will press against the guards 39 in such a manner as to cause them to be pushed into their recesses 40 sufficiently to enable the finger to come into contact with the cutting edge of either blade. At the same time, the shape of the guards is such that they readily retract when the knife is used to cut cardboard or other sheet material since the guards are pushed directly into their slots as a result of their bearing directly on the surface of the sheet material being cut on either side of the cut. During cutting the sheet material is generally substantially parallel to the surface 21 on the handle and thus the pressure exerted by the sheet material is generally in the direction of the axis of sliding of the guards 39 in the recesses 40. When a finger is pressed against the guards 39, on the other hand, it can only be pressed against the inclined side 47 of each guard and thus a much greater force is required to retract the guards.

In some cases it may be desirable for the width of the effective slot into which the sheet material passes to be matched to the thickness of the sheet material. In the arrangement shown in the drawings the effective width of the slot is the distance between the inner surface of the tang 25 and the adjacent edge surface 21 of the knife handle. While this distance as shown may be necessary for cutting thick card, it might improve the cutting of thinner card if the effective width of this slot were smaller. This effect could be achieved by permitting adjustment of the extent to which the guards 39 may be retracted into their recesses 40. In the arrangements shown the guards may retract fully into the slots so that they become flush with the edge surface 21 exposing the full width of the slot between the tang 25 and the surface 21. However, adjustment means might be provided so that, at the inward limit of their retracting movement, the guards 39 still project beyond the surface 21 but to a lesser extent. The effective width of the slot leading to the cutting edges of the blades is then effectively reduced to the distance between the inner edge of the tang 25 and the outer parts of the guards 39. Any convenient means may be employed for limiting the inward movement of the guards 39. For example, an adjustable abutment may be provided for engagement by the pin 44 to limit the distance which the pin 44 can move along the slot 45.

Alternatively, means may be provided for locating the guards 39 fixedly in one or more positions relative to the surface 21 and the tang 25. In this case the outer extremities of the guards 39 will be spaced inwardly of the inner edge of the tang 25, thus reducing the effective width of the gap into which the sheet material can be passed. A small region of the cutting edges of the two blades will therefore be exposed and the guards 39 will not be retractable. Accordingly, they will be slightly less effective than retractable spring-loaded guards for the purpose of safety, but will still provide some reduction in the risk of a user being accidentally cut by the blades.

The present invention relates to the particular arrangement of the blades for actually cutting the material to be severed, and the arrangement of the blades 18 and 19 shown in the drawings is one preferred arrangement. Although one particular form of knife handle, in which the blades are mounted, is shown, this is only one of many possible designs of knife handle in which the blade arrangement according to the present invention may be used. The invention is not therefore intended to be limited to any particular features of the handle shown by way of example, and such features to do not form a part of the present invention.

Figure 6:
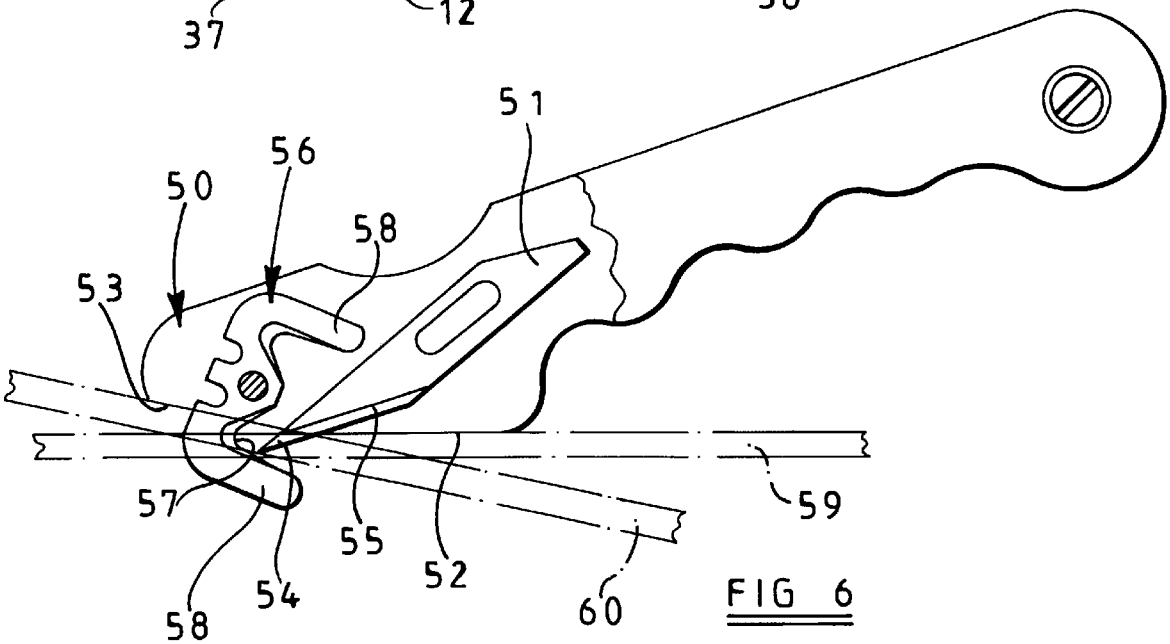

FIG. 6 shows a further form of safety knife in accordance with the invention. In this case there is mounted on the head portion 50 of the handle a pointed single-ended blade 51 of a commonly available type. The underside of the head portion 50 is formed with two angled flat surfaces 52, 53 and the point 54 of the cutting edge 55 of the blade 51 projects beyond the junction between the two surfaces.

In order to guard the point 54 of the blade 51, a second, double-ended hooked blade 56 is also mounted on the head portion 50 of the handle and has two concave cutting edges 57 one of which extends around the point of the blade 51. The blade 56 has two blunt limbs 58 one of which projects rearwardly beyond the point 54 of the blade 51.

The knife may be used to cut a sheet of cardboard as indicated at 59 or 60 in the drawing. The surface 52 of the knife may be drawn along the upper surface of a sheet of cardboard 59 so that the main cutting action is performed by the cutting edge 55 of the main blade 51, although the concave cutting edge 57 of the guard blade 56 provides a follow-up cutting action. In order to provide a steeper cutting angle for the cutting edge 55, the inclined surface 53 on the head portion 50 may be run along the upper surface of the cardboard as indicated at 60. By angling the hooked blade 56, the blunted point 58 can be used to pierce the cardboard to start a cut if required.

Figure 7:
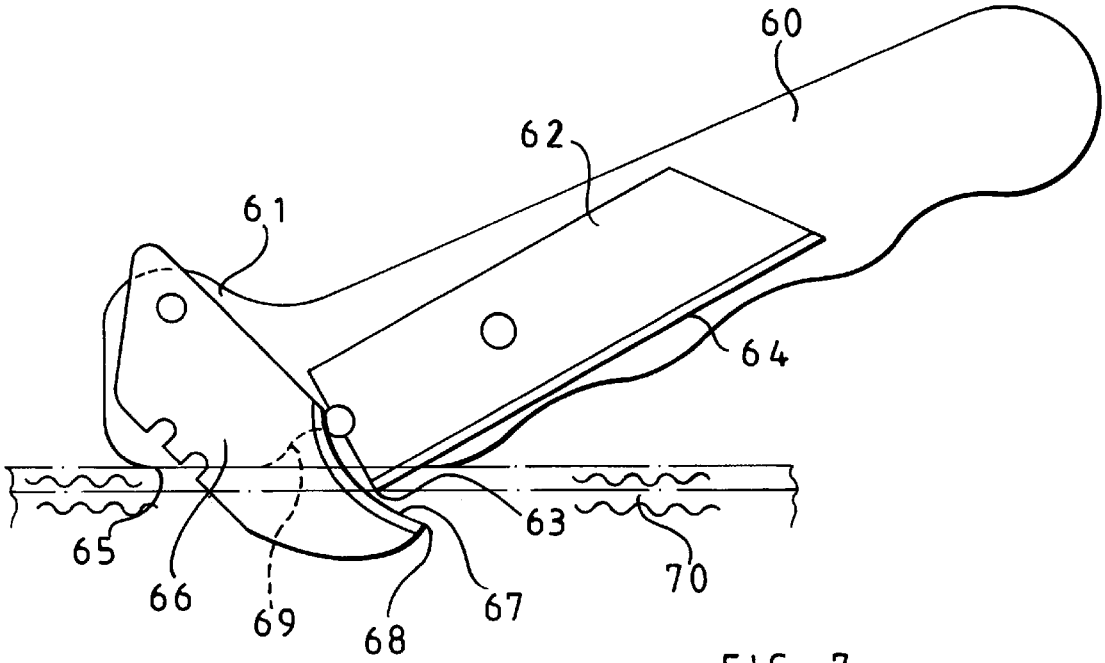

FIG. 7 shows a further form of knife according to the invention. The knife comprises a handle 60 which may conveniently be moulded from plastics or may be formed from any other suitable material. The handle is formed with a shaped hand-grip region and a head portion 61.

Mounted in the hand-grip region of the knife is a blade 62 of a commonly available type, having a cutting tip 63 on a cutting edge 64. The underside of the head portion 61 is formed with a flat surface 65 and the tip 63 of the cutting edge 64 of the blade 62 projects beyond the surface 65.

In order to guard the tip 63 of the blade 62, a second blade 66 is mounted on the head portion 61 of the handle and has a concave cutting edge 67 which extends generally around the tip 63 of the blade 62, there being a small gap between the cutting edge 67 and the tip 63. The point 68 of the concave blade 66 projects outwardly and rearwardly beyond the tip 63 of the blade 62. The edge 65 of the head portion 61 of the knife is formed with a curved cut-out 69 in front of the tip 63 of the blade 62, and in the region where the concave cutting edge 67 of the blade 66 passes into the handle.

The knife may be used to cut a sheet of cardboard as indicated at 70 in the drawing. The surface 65 of the knife may be drawn along the upper surface of the sheet of cardboard 70 so that the main cutting action is performed by the cutting edge 64 of the main blade 62, although the concave cutting edge 67 of the guard blade 66 provides a follow-up cutting action. By angling the concave blade 66, its sharp point 68 can be used to pierce the cardboard to start a cut, if required.

FIGS. 8–12 show various other blade arrangements for use in safety knives according to the present invention. In each case the hooked guard blade 71, 72 or 73 is of a similar kind to that shown in FIG. 1 and comprises a central portion 74 having two generally parallel unsharpened edges, opposite ends of the blade being formed with transverse tangs 75 extending approximately at right angles to the main axis of the blade. Concavely curved sharpened cutting edges 76 are formed between the tangs 75 and the main central portion of the blade 74.

In the arrangement of FIG. 8 the hooked guard blade 71 is mounted transversely across the end of a shaped knife handle 77 so that the tangs 75 and curved cutting edges 76 are exposed at each side of the handle.

Two small trapezium-shaped blades 78 are mounted on the head portion of the handle 77 so that the cutting edges 79 of the blades face outwardly and the points 80 of the blades are surrounded by the curved cutting edges 76 on the hooked guard blade 71. The points 80 of the small blade 78 may just touch the curved cutting edges 76 or may be spaced short distance inwardly therefrom. The blades 78 are double-ended so that when one point of each blade is worn the blade may be reversed to bring the opposite point into position adjacent the curved cutting edge 76.

FIG. 9 shows a slightly modified version of the arrangement shown in FIG. 8 where each small blade 81 (only one of which is shown) is single ended and is therefore non-reversible.

FIG. 10 shows an arrangement where a single larger trapezium-shaped blade 82 having sharpened inclined end edges 83 lies alongside the hooked guard blade 71 so that the points 84 on each end of the blade 82 are partly surrounded by the concave cutting edges 76 on the hooked blade 71.

FIG. 11 shows a further modification of the arrangement shown in FIG. 8. In this case the hooked guard blade 72 is more rectangular in shape and the small trapezium-shaped blades 85 are larger than the blades 78 in FIG. 8 and overlap so that their points 86 are partly surrounded by the curved cutting edges on the hooked blade 72. The dimensions of the overlapping blades 85 may be such that central holes 87 in the two blades are in register so that they may be secured in position on the knife handle (not shown) by a single fastener.

FIG. 12 shows an arrangement where the main blade 88 is of the well known "snap off" type where the blade is formed with a number of transverse parallel inclined lines of weakness 89 so that successive portions 90 of the blade may be snapped off as their cutting edges 91 become blunt. The point 92 of the leading end portion 90 of the blade 88 is surrounded by the curved cutting edge on the hooked guard blade 73 as in the arrangements described above. The blade 88 requires to be removable from the knife handle in order that a used portion 90 may be snapped off, and also requires to be longitudinally slidable on the handle so that when an end portion 90 has been snapped off, the blade 88 may be slid towards the blade 73 to bring the point of the next portion 90 into position adjacent the cutting edge of the guard blade 73. As shown in FIG. 12, the unsharpened inner surface of the hooked blade 73 may be shaped to register with the inclined end of the main blade 88, so as to locate the point 92 of the blade in the correct location with respect to the curved cutting edge on the guard blade.

Figure 13:
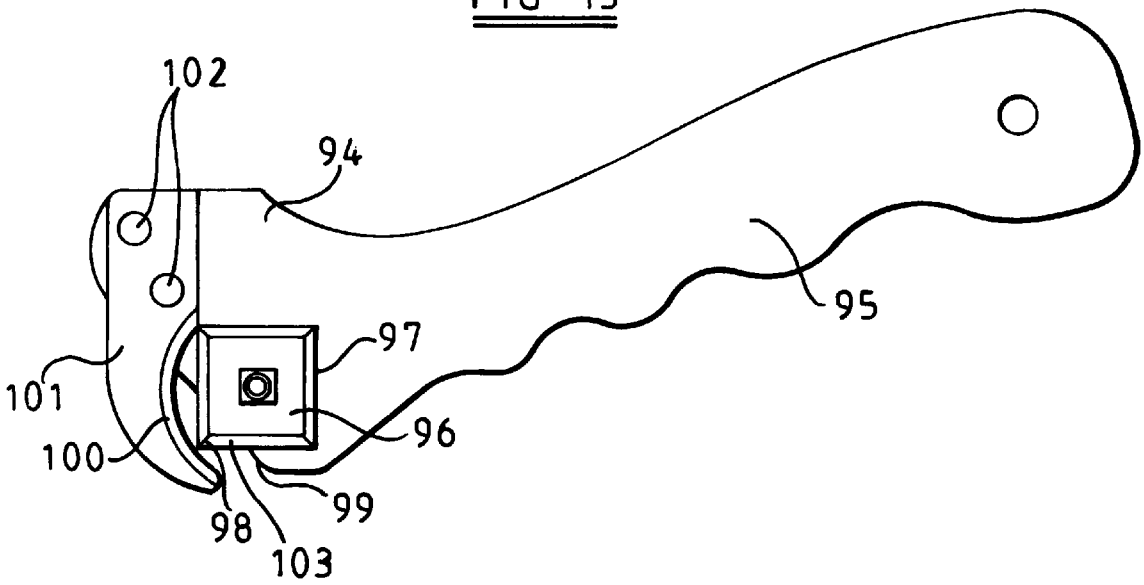
Figure 14:
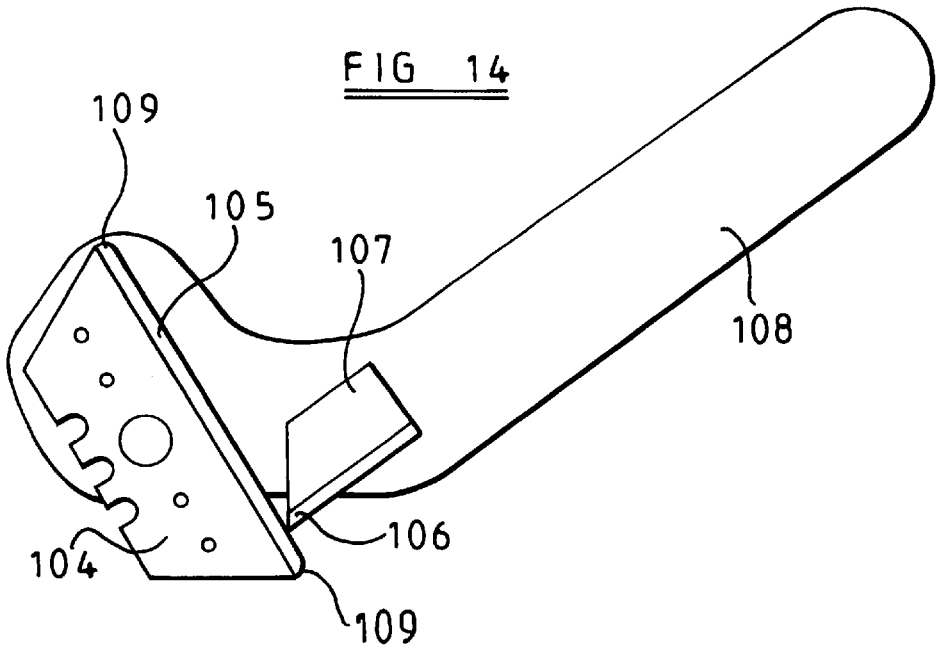

FIG. 13 shows another form of safety knife in accordance with the invention and in this case the head portion 94 of the knife handle 95 has mounted thereon a generally square main blade 96 having four sharpened cutting edges 97. The blade 96 is rotatably adjustable on the handle 95, as will be described.

One corner 98 of the blade 96 projects beyond an inclined surface 99 on the head portion 94 of the blade and is partly surrounded by a concavely curved cutting edge 100 on a hooked guard blade 101 which is mounted on the head portion 94 as indicated at 102.

The safety knife operates in similar fashion to those described above in relation to the preceding figures, the main cutting action of cardboard or other material being effected by the exposed cutting edge 103 of the comer 98 of the blade 96, the comer of the blade being guarded and protected by the curved cutting edge 100 which also performs a follow-up cutting action.

The square blade 96 is mounted on the handle 95 by an adjustable mechanism whereby the blade may be rotatably indexed through successive angles of 90°, so as to bring any of the four corners of the blade 96 into position adjacent the curved edge 100. Preferably the indexing mechanism is operated by a manipulating knob or lever exposed on the side of the handle 95, and preferably also includes a latching device to locate the blade 96 in each of its four positions. The latching device may be operated by a manually releasable clamp, or may be an automatic spring device which must be overcome by applying a comparatively strong force to rotate the blade using the external knob or lever. Preferably the concave cutting edge 100 on the guard blade 101 is part-circular and is concentric with the axis of rotation of the square blade 96.

As each cutting edge 103 of the blade 96 becomes blunt, the blade may be rotated through 90° to bring a fresh cutting edge into position. Since it is only the outwardly facing cutting edge on the exposed corner 98 of the blade which is subject to wear in use, the blade 96 effectively provides eight different cutting edges. Thus, after the blade has been rotated to all four of its indexable positions it may be removed from the handle and turned over to expose four unused portions of the side edges of the blade. It may happen that as the exposed leading cutting edge 103 of the blade passes through the material being cut, the trailing cutting edge on the inner side of the exposed corner 98 of the blade may be "stropped" and thus sharpened by the passage of the material across it.

In a modification of the arrangement shown in FIG. 13, the hooked guard blade 101 may be pivotally mounted on the head portion 94 of the handle so that it may be swung away from the exposed corner 98 of the main blade 96 to allow the main blade to be used for scoring cardboard or other material. This feature may also be applied to any of the other knives according to the present invention.

Also, in the arrangement of FIG. 13 as well as in other forms of the safety knife according to the invention, there may be mounted on the knife handle a guard in the form of a rotatably mounted cam which rotates in a plane which is generally parallel to the main blade of the safety knife. The cam is so shaped and dimensioned that, as it is rotated to different positions, different depths of the cam project beyond the surface of the knife from which the main blade itself projects. The surface of the cam may thus act as an adjustable depth guard for the projecting portion of the main blade. The cam may be so shaped that it may be brought to a safety position where it provides a complete guard for the exposed portion of the blade. In other positions the cam allows controlled depth cutting and scoring with the knife.

Figure 4:
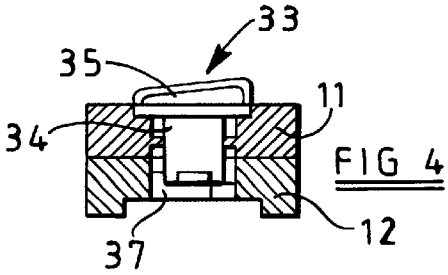
FIG. 4 is a section on the Line 4—4 of FIG. 2 showing the catch for securing the two halves of the knife together.
Figure 5:
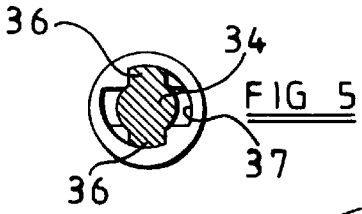
FIG. 5 is an end view of the catch shown in FIG. 4, FIGS. 6–8 are diagrammatic longitudinal sections through alternative forms of safety knife according to the invention.

In all of the arrangements described above, the cutting edge of the guard blade is concavely curved and extends around a part of the cutting edge of the main blade of the knife. While this is the preferred arrangement, FIG. 4 shows an alternative arrangement where the guard blade 104 is a trapezium-shaped blade having a straight cutting edge 105 which extends across the projecting point 106 of a main blade 107 mounted on the knife handle 108. In this case the ends of the cutting edge 105 of the guard blade are rounded, as indicated at 109, to avoid the exposure of a sharp point which would prejudice the safety aspects of the knife. One reason why the use of a curved cutting edge on the guard blade is preferred is that it more readily provides a safer blunt edge protecting the point of the main blade.

In any of the arrangements according to the present invention, the handle of the knife may be formed in two parts which are secured together by one or more screws, or other clamping devices, to clamp the main blade and guard blade between the parts of the handle. This allows the parts of the handle to be separated to enable either of the blades to be replaced or re-located. However, for a simpler and cheaper construction, the blades may be integrally moulded within a plastics handle to provide a cheap disposable knife.

What is claimed is:

1. A safety knife comprising a handle, a main blade mounted on the handle with at least a portion of the cutting edge of the blade projecting from the handle, the main blade defining a point, and a guard mounted on the handle to shield the projecting portion and the point of the blade, the guard comprising a further blade which is mounted on the handle in generally the same plane as the main blade and has a cutting edge of at least a part of which is directed towards said projecting portion of the main blade, the further blade being of concavely curved form and defining a tang disposed outwardly beyond the point of the main blade and extending around the point of the main blade.

2. A safety knife according to claim 1, wherein at least a portion of the cutting edge of the further blade which is directed towards the projecting portion of the main blade is concavely curved.

3. A safety knife according to claim 2, wherein the concavely curved portion of the cutting edge of the further blade extends around a part of the cutting edge of the main blade.

4. A safety knife according to claim 3, wherein the concavely curved portion of the further blade extends around ajunction between the cutting edge of the main blade and an adjacent edge of the main blade.

5. A safety knife according to claim 4, wherein said adjacent edge of the main blade is unsharpened.

6. A safety knife according to claim 4, wherein said adjacent edge of the main blade is sharpened.

7. A safety knife according to claim 3, wherein the portion of the concave edge of the further blade which extends around a part of the cutting edge of the main blade extends at an acute angle to the cutting edge of the main blade.

8. A safety knife according to claim 7, wherein said portion of the curved edge extends generally parallel to an edge surface of the handle from which the main blade projects, or at a small angle to the parallel direction.

9. A safety knife according to claim 3, wherein said tang of the further blade has an inner edge, which forms part of said concave edge around part of the cutting edge of the main blade, and an outer edge.

10. A safety knife according to claim 9, wherein the free end of the tang is at least partly rounded.

11. A safety knife according to claim 9, wherein the distance of the tang from a portion of the knife handle is is sufficiently small to prevent, or reduce the risk of, a finger of a user coming into contact with the exposed portion of the main blade.

12. A safety knife according to claim 1, wherein the handle has an edge from which the main blade projects, and a portion of the cutting edge of the main blade projects at an obtuse angle beyond said edge of the handle of the knife.

13. A safety knife according to claim 1, wherein the projecting portion of the main blade has an angle between an exposed portion of its cutting edge and the blade edge which is adjacent said exposed portion which is about 90°.

14. A safety knife according to claim 1, wherein the projecting portion of the main blade has an angle between an exposed portion of its cutting edge and the blade edge which is adjacent said exposed portion which is less than 90°.

15. A safety knife according to claim 1, wherein the main blade is trapezium shaped so that, by reversing the blade longitudinally, opposite pointed ends of the blade may project beyond the edge surface of the knife handle.

16. A safety knife according to claim 1, wherein the further blade is a cutting blade of the kind comprising a central portion having front and back unsharpened edges and two similar hook-shaped portions at opposite ends thereof, each hook portion comprising an inner concave sharpened cutting edge and an outer unsharpened edge.

17. A safety knife according to claim 16, including two main blades, cooperating with the two hook portions respectively.

18. A safety knife according to claim 16, wherein each hook portion cooperates with a different portion of a single main blade.

19. A safety knife according to claim 18, wherein the main blade is trapezium shaped and an unsharpened end edge of the main blade extends along or substantially parallel to the unsharpened inner edge of the hooked blade with the point between said end edge of the main blade and the cutting edge of the main blade projecting into the concavely curved cutting edge of the hooked blade so that the point of the main blade lies adjacent the cutting edge of the hooked blade.

20. A safety knife comprising a handle, a main blade mounted on the handle with at least a portion of the cutting edge of the blade projecting from the handle, and a guard mounted on the handle to shield the projecting portion of the blade, the guard comprising a further blade which is mounted on the handle in generally the same plane as the main blade and has a cutting edge at least a part of which is directed towards said projecting portion of the main blade, wherein the further blade is a cutting blade of the kind comprising a central portion having front and back unsharpened edges and two similar hook-shaped portions at opposite ends thereof, each hook portion comprising an inner concave sharpened cutting edge and an outer unsharpened edge.

21. A safety knife according to claim 20, including two main blades, co-operating with the two hook portions respectively.

22. A safety knife according to claim 20, wherein each hook portion co-operates with a different portion of a single main blade.

23. A safety knife according to claim 22, wherein the main blade is trapezium shaped and an unsharpened end edge of the main blade extends along or substantially parallel to the unsharpened inner edge of the hooked blade with the point between said end edge of the main blade and the cutting edge of the main blade projecting into the concavely curved cutting edge of the hooked blade so that the point of the main blade lies adjacent the cutting edge of the hooked blade.

* * * * *